US008228249B2

(12) United States Patent
Sugimoto et al.

(10) Patent No.: US 8,228,249 B2
(45) Date of Patent: Jul. 24, 2012

(54) IN-VEHICLE ANTENNA DEVICE

(75) Inventors: Yuji Sugimoto, Kariya (JP); Kiyokazu Akiyama, Okazaki (JP); Michio Shamoto, Konan (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 299 days.

(21) Appl. No.: 12/800,660

(22) Filed: May 20, 2010

(65) Prior Publication Data

US 2010/0302113 A1 Dec. 2, 2010

(30) Foreign Application Priority Data

May 28, 2009 (JP) ..... 2009-128965

(51) Int. Cl.
*H01Q 1/32* (2006.01)

(52) U.S. Cl. ..... 343/711; 343/713

(58) Field of Classification Search ..... 343/711, 343/713, 700 MS
See application file for complete search history.

(56) References Cited

U.S. PATENT DOCUMENTS

| | | | | |
|---|---|---|---|---|
| 5,945,959 | A | 8/1999 | Tanidokoro et al. | |
| 6,087,990 | A * | 7/2000 | Thill et al. | 343/700 MS |
| 7,321,338 | B2 * | 1/2008 | Komatsu et al. | 343/846 |
| 7,446,719 | B2 * | 11/2008 | Sugimoto et al. | 343/713 |
| 7,586,386 | B2 * | 9/2009 | Takahashi | 333/26 |
| 7,633,453 | B2 * | 12/2009 | Kono et al. | 343/713 |
| 2004/0135731 | A1 | 7/2004 | Komatsu et al. | |
| 2005/0134510 | A1 | 6/2005 | Asai | |
| 2005/0264461 | A1 | 12/2005 | Sugimoto et al. | |
| 2007/0024511 | A1 | 2/2007 | Li et al. | |

FOREIGN PATENT DOCUMENTS

| | | |
|---|---|---|
| JP | 4-064978 | 2/1992 |
| JP | 10-107534 | 4/1998 |
| JP | 2001-136014 | 5/2001 |
| JP | 2002-290138 | 10/2002 |
| JP | 2005-142984 | 6/2005 |
| JP | 2005-167762 | 6/2005 |
| JP | 2007-37129 | 2/2007 |
| JP | 2007-214642 | 8/2007 |
| JP | 2008-113407 | 5/2008 |
| JP | 2008-306663 | 12/2008 |
| JP | 2008-306664 | 12/2008 |

OTHER PUBLICATIONS

Office action dated Oct. 4, 2011 in corresponding Japanese Application No. 2009-128965.
Office action dated Apr. 26, 2011 in corresponding Japanese Application No. 2009-128965.

* cited by examiner

*Primary Examiner* — Hoang V Nguyen
(74) *Attorney, Agent, or Firm* — Harness, Dickey & Pierce, PLC

(57) ABSTRACT

An in-vehicle antenna device includes: a dielectric element having a front surface, first and second side surfaces and a rear surface and including a power supply point on both the first and second side surfaces, a first conductive surface on the first side surface, a second conductive surface on the second side surface, and a third conductive surface on the rear surface; and an antenna element including a base element coupled with the power supply point at one corner of the front surface and a branch element connected to the base element and having an end. A part of the branch element moves apart from one of the first and second conductive surfaces as it goes from the base element to the one end of the branch element. The front surface is attached to a windshield of a vehicle.

9 Claims, 4 Drawing Sheets

IN-VEHICLE ANTENNA DEVICE

CROSS REFERENCE TO RELATED APPLICATION

This application is based on Japanese Patent Application No. 2009-128965 filed on May 28, 2009, the disclosure of which is incorporated herein by reference.

FIELD OF THE INVENTION

The present invention relates to an in-vehicle antenna device.

BACKGROUND OF THE INVENTION

A film antenna as an in-vehicle antenna mounted on a vehicle is disclosed in JP-B2-4064978 corresponding to US Patent Application Publication No. 2005/0264461. The film antenna is arranged on and attached to a wind shield glass of the vehicle near a corner, at which a roof of a body and a pillar cross. Further, a technique for increasing a gain of an antenna having double loop shape is disclosed in JP-A-2008-113407. In the technique, a reflection element is arranged on a rear side of the antenna element.

The film antenna can be attached to a predetermined position of the windshield, which does not hinder front vision of a driver of the vehicle. Thus, the vision of the driver in front of the vehicle is secured. However, in this case, the film antenna transmits an electro-magnetic wave not only toward an outside of a compartment of the vehicle but also toward an inside of the compartment. Thus, when a communication device is disposed in the compartment, and the communication device uses the same communication frequency zone as the film antenna, the electro-magnetic wave from the film antenna may affect operation of the communication device. When the antenna having a double loop shape is mounted on the vehicle, it is necessary to secure a distance between the antenna and a body of the vehicle. Accordingly, when the antenna having a double loop shape is arranged on the windshield of the vehicle, it is difficult to secure the front vision of the driver.

SUMMARY OF THE INVENTION

In view of the above-described problem, it is an object of the present disclosure to provide an in-vehicle antenna device. Even when the in-vehicle antenna device is arranged on a windshield of the vehicle, a front vision of a driver is sufficiently secured. Further, even when a communication device using the same communication frequency zone as the in-vehicle antenna device is disposed in a compartment of the vehicle, the communication device is not affected by the in-vehicle antenna.

According to an aspect of the present disclosure, an in-vehicle antenna device includes: a dielectric element having a front surface, first and second side surfaces and a rear surface, wherein a distance between the front surface and the rear surface is substantially equal to a product of one-fourth of a wavelength of an electromagnetic wave and a shortening ratio of the wavelength of the electromagnetic wave passing through the dielectric element, and wherein the dielectric element includes a power supply point disposed on both of the first and second side surfaces, a first conductive surface disposed on the first side surface, a second conductive surface disposed on the second side surface, and a third conductive surface disposed on the rear surface; and an antenna element including a base element and a branch element, wherein the base element is coupled with the power supply point at one corner of the front surface, wherein the branch element is connected to the base element and has an end opposite to the base element, and wherein a part of the branch element moves apart from one of the first and second conductive surfaces as it goes from the base element to the one end of the branch element. The front surface of the dielectric element is attached to a windshield of a vehicle near a corner, at which a roof and a pillar of the vehicle intersect.

In the above device, since the first and second conductive surfaces function as a ground, the area of the device is reduced so that a vision of a driver of the vehicle is appropriately secured. Further, since the third conductive surface functions as a reflection plate, the electromagnetic wave is restricted from being irradiated into a compartment of the vehicle. Even when a communication device using the same communication frequency zone as the in-vehicle antenna device is disposed in the compartment of the vehicle, the communication device is not affected by the in-vehicle antenna. Furthermore, a gain of the antenna device to an outside of the compartment is improved. Since the first and second conductive surfaces function as a reflection plate, the electromagnetic wave is restricted from being irradiated to a side of the vehicle.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

First Embodiment

Figure 1:
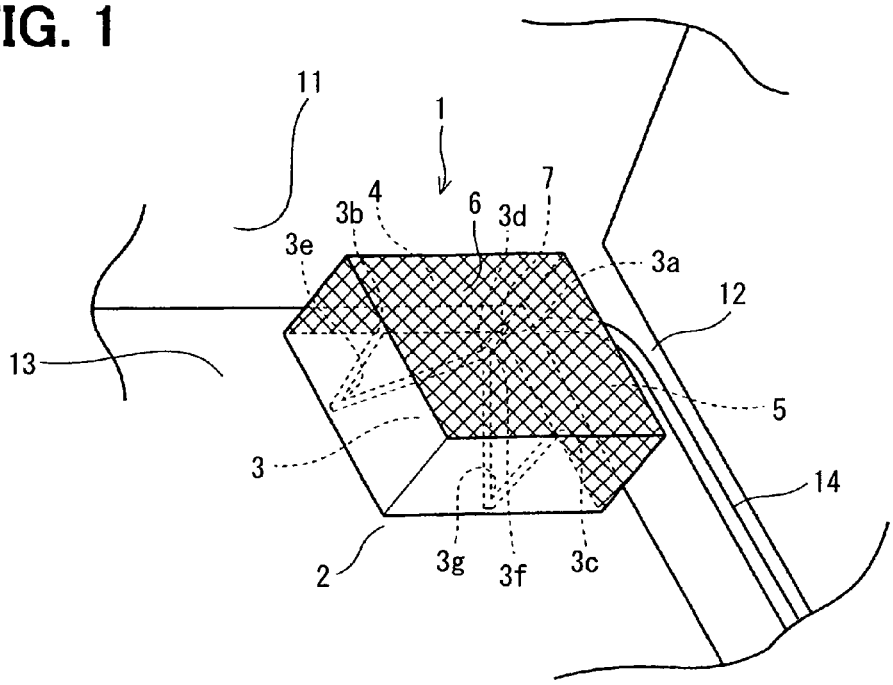
FIG. 1 is a diagram showing an in-vehicle antenna device on a windshield of a vehicle according to a first embodiment.
Figure 2A:
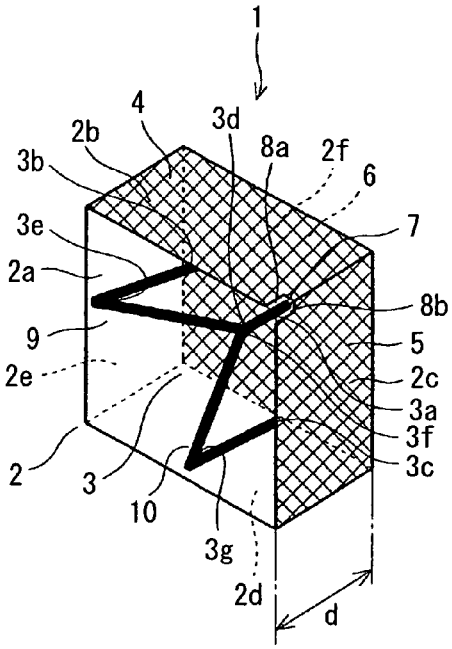
FIG. 2A is a diagram showing a perspective view of the in-vehicle antenna device viewed from a front side.
Figure 2B:
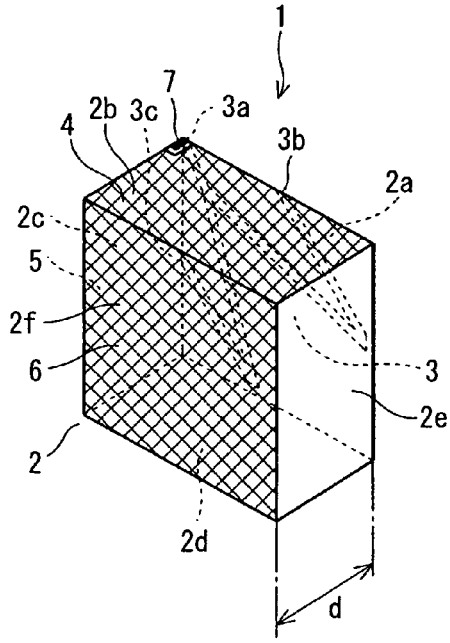
FIG. 2B is a diagram showing a perspective view of the in-vehicle antenna device viewed from a rear side.

An in-vehicle antenna device 1 according to a first embodiment is shown in FIGS. 1 to 3D. The antenna device 1 includes a dielectric element 2 and an antenna element 3, which is formed on the dielectric element 2. The dielectric element 2 has a rectangular parallelepiped shape with a front surface 2*a*, four side surfaces 2*b*-2*e* and a rear surface 2*f*. A conductive member is arranged on two side surfaces 2*b*, 2*c* and the rear surface 2*f* so that three conductive surfaces 4-6 are formed. Each conductive surface 4-6 is hatched in FIGS. 1 and 2A-2B.

One conductive surface 4 is formed on almost all of the side surface 2*b* other than a part, which is disposed around a boundary between the side surface 2*b* and the side surface 2*c*. Another conductive surface 5 is formed on almost all of the side surface 2*c* other than a part, which is disposed around a boundary between the side surface 2*b* and the side surface 2*c*. Another conductive surface 6 is formed on all of the rear surface 2*f*. The conductive surfaces 4-6 are formed from a conductive foil such as a copper foil or a conductive paste such as silver paste.

A power supply point 7 is formed on the part of the side surface 2*b*, on which the conductive surface 4 is not formed, and the part of the side surface 2*c*, on which the conductive surface 5 is not formed, so that the power supply point 7 is disposed on both of the side surface 2*b* and the side surface 2*c*. The power supply point 7 and the conductive surface 4 are insulated from each other with an insulation region 8*a*, and the power supply point 7 and the conductive surface 5 are insulated from each other with an insulation region 8*b*. A height of the side surfaces 2*b*-2*e* is defined by d in FIGS. 2A and 2B. It is preferable that the height d is almost equal to a product of one-fourth of a wavelength of the used frequency of the electromagnetic wave and a shortening ratio of a wavelength of the electromagnetic wave passing through the dielectric element 2. The height d may be slightly different from the product within a predetermined allowance.

The antenna element 3 is formed on the front surface 2*a* of the dielectric element 2 such that the antenna element 3 is in parallel to a surface orientation of the rear surface 2*f*. The antenna element 3 includes one base antenna element 3*a* and two ends 3*b*, 3*c* such that the two ends 3*b*, 3*c* are branched from the base antenna element 3*a*. The antenna element 3 further includes a first antenna element 9 and a second antenna element 10. The first antenna element 9 has a L shape, which is branched from the base antenna element 3*a* toward the first end 3*b*. Specifically, the L shape of the first antenna element 9 has a bending portion 3*d* with an obtuse angle and another bending portion 3*e* with an acute angle. The second antenna element 10 has a L shape, which is branched from the base antenna element 3*a* toward the second end 3*c*. Specifically, the L shape of the second antenna element 10 has a bending portion 3*f* with an obtuse angle and another bending portion 3*g* with an acute angel. Thus, the base antenna element 3*a* is branched to the first and second antenna elements 9, 10.

A part of the first antenna element 9 between the base antenna element 3*a* and the bending portion 3*e* with the acute angel is separated from the conductive surface 4 on the side surface 2*b* as it goes from the base antenna element 3*a* to the bending portion 3*e* with the acute angel. A part of the second antenna element 10 between the base antenna element 3*a* and the bending portion 3*g* with the acute angel is separated from the conductive surface 5 on the side surface 2*c* as it goes from the base antenna element 3*a* to the bending portion 3*g* with the acute angel.

The base antenna element 3*a* is electrically coupled with the power supply point 7 at one corner of the front surface 2*a*. The first end 3*b* is electrically coupled with the conductive surface 4 on the side surface 2*b* at a middle point of the boundary between the side surface 2*b* and the front surface 2*a*. The second end 3*c* is electrically coupled with the conductive surface 5 on the side surface 2*c* at a middle point of the boundary between the side surface 2*c* and the front surface 2*a*. Thus, in the antenna element 3, the first antenna element 9 provides a loop shape, and the second antenna element 10 provides a loop shape. Thus, a double loop structure is formed, and the double loop structure has line-symmetry with reference to a line between the one corner of the front surface 2*a* and an opposing corner of the front surface 2*a*.

A first element length of the first antenna element 9 is defined as a length from the base antenna element 3*a* to the first end 3*b*. A second element length of the second antenna element 10 is defined as a length from the base antenna element 3*a* to the second end 3*c*. Each of the first and second element lengths is a half of the wavelength of the usage frequency of the electromagnetic wave. This length is designed in view of the shortening ratio of the wavelength of the electromagnetic wave as a whole. The shortening ratio is in a range between 0.7 and 0.8 according to the dielectric constant of glass of the windshield.

As shown in FIG. 1, the in-vehicle antenna device 1 is arranged near a corner, at which the roof 11 of the body of the vehicle and the pillar 12 intersect. Specifically, a whole of the front surface 2*a* of the dielectric element 2 contacts the windshield 13. The power supply cable 14 is coupled with the power supply point 7. In this case, the conductive surface 4 formed on the side surface 2*b* of the dielectric element 2 is grounded to the roof 11 of the vehicle body. The conductive surface 5 formed on the side surface 2*c* of the dielectric element 2 is grounded to the pillar 12 of the vehicle body.

Since the conductive surface 4 is formed on the side surface 2*b* of the dielectric element 2, and the conductive surface 5 is formed on the side surface 2*c*, and the conductive surfaces 4, 5 provide a ground, the area of the in-vehicle antenna device 1 in parallel to the front surface 2*a* and the rear surface 2*f* is reduced. When electric power is supplied to the power supply point 7 of the antenna element 3 via the cable 14, an electromagnetic wave is emitted to the outside of the compartment, i.e., the wave is emitted to the front direction of the vehicle since the antenna element 3 provides the double loop structure having a double loop surface along with a surface orientation of the front surface 2*a* of the dielectric element 2. Although the electromagnetic wave is also emitted to the inside of the compartment, i.e., the wave is emitted to the rear side of the vehicle, the wave is reflected on the conductive surface 6 formed on the rear surface 2*f* of the dielectric element 2 since the conductive surface 6 is formed on almost a whole of the rear surface 2*f* of the dielectric element 2. Thus, the reflected electromagnetic wave is radiated to the front direction of the vehicle. Further, the conductive surface 4 on the side surface 2*b* and the conductive surface 5 on the side surface 2*c* functions as not only the ground but also a reflection plate, so that the electromagnetic wave is restricted to be emitted to a side direction of the vehicle.

Figure 3A:
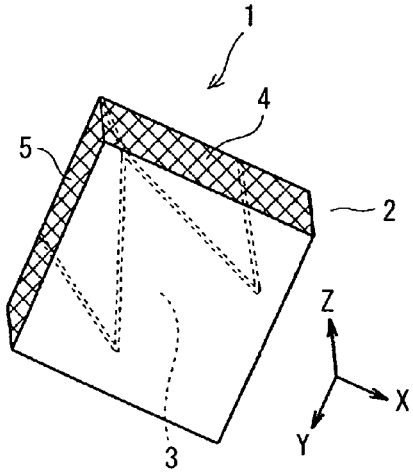
FIG. 3A is a diagram showing a perspective view of the in-vehicle antenna device having no conductive surface on the rear side.
Figure 3B:
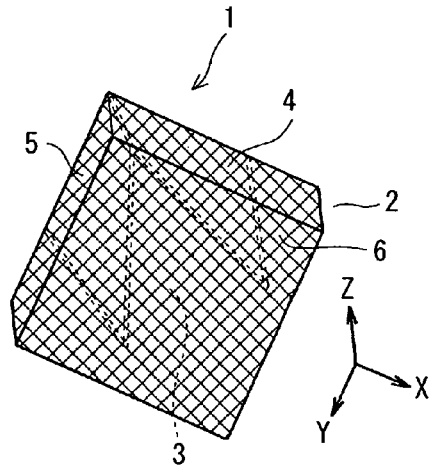
FIG. 3B is a diagram showing a perspective view of the in-vehicle antenna device having a conductive surface on the rear side.
Figure 3C:
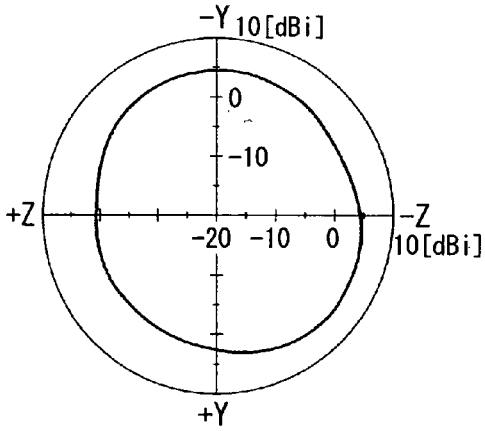
FIG. 3C is a diagram showing a graph of a simulation result of a gain of the in-vehicle antenna device in FIG. 3A.
Figure 3D:
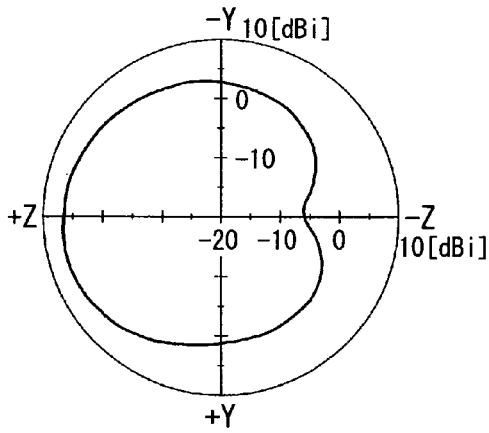
FIG. 3D is a diagram showing a graph of a simulation result of a gain of the in-vehicle antenna device in FIG. 3B.

To estimate the gain in the front direction of the vehicle, a simulation experiment is performed. FIGS. 3A to 3D show a simulation result. FIGS. 3A and 3C show a simulation result of a case where only the conductive surfaces 4, 5 are formed on the dielectric element 2 without the conductive surface 6. Specifically, FIG. 3C show a directionality pattern of the in-vehicle antenna device 1 without the conductive surface 6 on the rear surface 2*f*. FIGS. 3B and 3D show a simulation result of a case where the conductive surfaces 4, 5, 6 are formed on the dielectric element 2. Specifically, FIG. 3D show a directionality pattern of the in-vehicle antenna device 1 with the conductive surface 6 on the rear surface 2*f*. When the conductive surface 6 is formed on the rear surface 2*f*, the gain in the rear direction, i.e., −Z direction in FIG. 3D, is reduced. Further, the gain in the front direction, i.e., +Z direction in FIG. 3D, is increased. Thus, the conductive surface 6 on the rear surface 2*f* functions as a reflection plate.

In the first embodiment, in the in-vehicle antenna device 1, the conductive surface 4 is formed on the side surface 2*b* of the dielectric element 2, and the conductive surface 5 is formed on the side surface 2*c* of the dielectric element 2. The conductive surfaces 4, 5 functions as the ground so that the area of the in-vehicle antenna device in parallel to the front surface 2*a* is reduced. Thus, the front vision of a driver of the vehicle is sufficiently secured even when the device 1 is mounted on the windshield of the vehicle. Further, the conductive surface 6 on the rear surface 2*f* of the dielectric element 2 functions as a reflection plate. Thus, the electromagnetic wave is restricted from being emitted to the rear direction of the vehicle, i.e., restricted from being radiated into the compartment of the vehicle. Thus, even when the communication device having the same communication frequency zone as the in-vehicle antenna device 1 is disposed in the compartment of the vehicle, the communication device is protected from the electromagnetic wave emitted from the antenna device 1. Further, the gain of the antenna device 1 in the front direction of the vehicle is improved. Furthermore, the conductive surface 4 on the side surface 2*b* and the conductive surface 5 on the side surface 2*c* of the dielectric element 2 functions as not only the ground but also the reflection plate of the electromagnetic wave. Thus, the emission of the electromagnetic wave in the side direction is restricted.

Since the dielectric element 2 is made of material having high dielectric constant, the dimensions of the antenna element 3 is minimized. Further, the thickness of the dielectric element 2, i.e., the height of the side surfaces 2*b*-2*e*, is reduced to be equal to or smaller than one-fourth of the wavelength of the usage frequency of the electromagnetic wave. Thus, the dimensions of the antenna device 1 are minimized.

Second Embodiment

Figure 4:
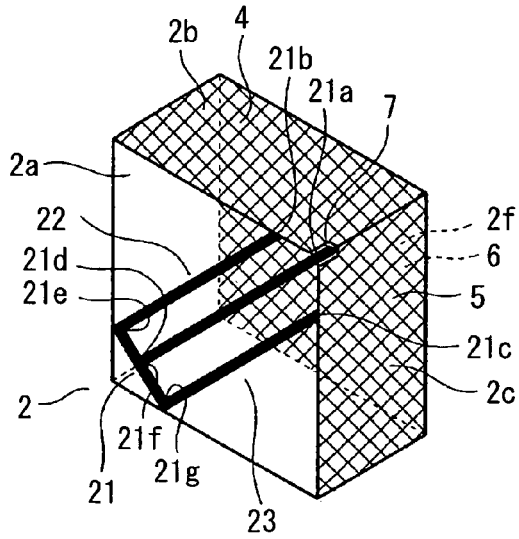
FIG. 4 is a diagram showing a perspective view of an in-vehicle antenna device viewed from a front side according to a second embodiment.

An in-vehicle antenna device 1 according to a second embodiment is shown in FIG. 4. A shape of the antenna element 21 in FIG. 4 is different from that in FIG. 2A. Specifically, the antenna element 21 includes one base antenna element 21*a* and two ends 21*b*, 21*c* such that the two ends 21*b*, 21*c* are branched from the base antenna element 21*a*. The antenna element 21 further includes a first antenna element 22 and a second antenna element 23. The first antenna element 22 has a U shape, which is branched from the base antenna element 21*a* toward the first end 21*b*. Specifically, the U shape of the first antenna element 22 has a bending portion 21*d* with a right angle and another bending portion 21*e* with a right angle. The second antenna element 23 has a U shape, which is branched from the base antenna element 21*a* toward the second end 21*c*. Specifically, the U shape of the second antenna element 23 has a bending portion 21*f* with a right angle and another bending portion 21*g* with a right angel. Thus, the base antenna element 21*a* is branched to the first and second antenna elements 22, 23.

A part of the first antenna element 22 between the base antenna element 21*a* and the bending portion 21*d* with the right angel is separated from the conductive surface 4 on the side surface 2*b* as it goes from the base antenna element 21*a* to the bending portion 21*d* with the acute angel. A part of the second antenna element 23 between the base antenna element 21*a* and the bending portion 21*f* with the right angel is separated from the conductive surface 5 on the side surface 2*c* as it goes from the base antenna element 21*a* to the bending portion 21*f* with the right angel.

The base antenna element 21*a* is electrically coupled with the power supply point 7 at one corner of the front surface 2*a*. The first end 21*b* is electrically coupled with the conductive surface 4 on the side surface 2*b* at the boundary between the side surface 2*b* and the front surface 2*a*. The second end 21*c* is electrically coupled with the conductive surface 5 on the side surface 2*c* at the boundary between the side surface 2*c* and the front surface 2*a*. Thus, in the antenna element 21, the first antenna element 22 provides a turn-back shape, i.e., a loop-back shape, and the second antenna element 10 provides a turn-back shape, i.e., a loop-back shape. Thus, a double loop structure is formed, and the double loop structure has line-symmetry with reference to a line between the one corner of the front surface 2*a* and an opposing corner of the front surface 2*a*.

A first element length of the first antenna element 22 is defined as a length, from the base antenna element 21*a* to the first end 21*b*. A second element length of the second antenna element 23 is defined as a length from the base antenna element 21*a* to the second end 21*c*. Each of the first and second element lengths is a half of the wavelength of the usage frequency of the electromagnetic wave. As shown in FIG. 4, the in-vehicle antenna device 1 is arranged near a corner, at which the roof 11 of the body of the vehicle and the pillar 12 intersect. Specifically, a whole of the front surface 2*a* of the dielectric element 2 contacts the windshield 13. The power supply cable 14 is coupled with the power supply point 7. Thus, the device in FIG. 4 provides the same effect as the device in FIG. 1.

Third Embodiment

Figure 5:
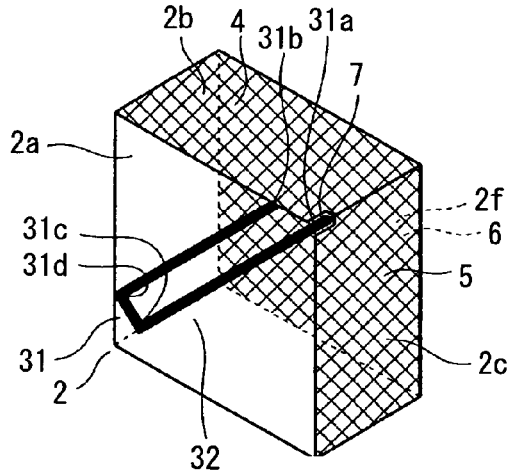
FIG. 5 is a diagram showing a perspective view of an in-vehicle antenna device viewed from a front side according to a third embodiment.

An in-vehicle antenna device 1 according to a third embodiment is shown in FIG. 5. A shape of the antenna element 31 in FIG. 5 is different from that in FIG. 2A. Specifically, the antenna element 31 includes one base antenna element 31*a* and one end 31*b*. The antenna element 31 further includes a antenna element portion 32. The antenna element portion 32 has a U shape, which, extends from the base antenna element 31*a* toward the one end 31*b*. Specifically, the U shape of the antenna element portion 32 has a bending portion 31*c* with a right angle and another bending portion 31*d* with a right angle. A part of the antenna element portion 32 between the base antenna element 31*a* and the bending portion 31*c* with the right angel is separated from the conductive surface 4 on the side surface 2*b* as it goes from the base antenna element 31*a* to the bending portion 31*c* with the acute angel. Further, the part of the antenna element portion 32 between the base antenna element 31*a* and the bending portion 31*c* with the right angel is separated from the conductive surface 5 on the side surface 2*c* as it goes from the base antenna element 31*a* to the bending portion 31*c* with the right angel.

The base antenna element 31*a* is electrically coupled with the power supply point 7 at one corner of the front surface 2*a*. The one end 31*b* is electrically coupled with the conductive surface 4 on the side surface 2*b* at the boundary between the side surface 2*b* and the front surface 2*a*. Thus, in the antenna element 21, the antenna element 31 provides a turn-back shape, i.e., a loop-back shape.

A element length of the antenna element portion 32 is defined as a length from the base antenna element 31*a* to the one end 31*b*. The element length is a half of the wavelength of the usage frequency of the electromagnetic wave. As shown in FIG. 5, the in-vehicle antenna device 1 is arranged near a corner, at which the roof 11 of the body of the vehicle and the pillar 12 intersect. Specifically, a whole of the front surface 2*a* of the dielectric element 2 contacts the windshield 13. The power supply cable 14 is coupled with the power supply point 7. Thus, the device in FIG. 5 provides the same effect as the device in FIG. 1.

Fourth Embodiment

Figure 6:
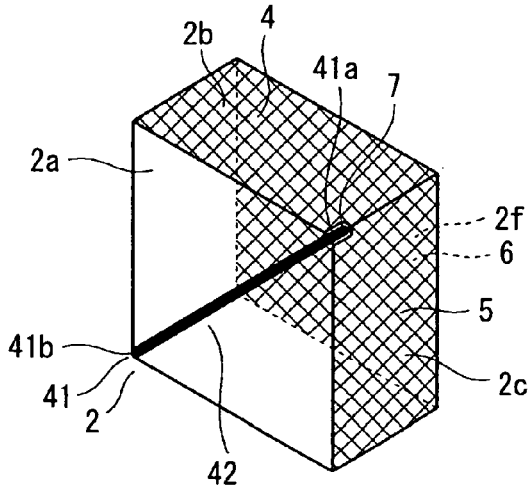
FIG. 6 is a diagram showing a perspective view of an in-vehicle antenna device viewed from a front side according to a fourth embodiment.

An in-vehicle antenna device 1 according to a fourth embodiment is shown in FIG. 6. A shape of the antenna element 41 in FIG. 6 is different from that in FIG. 2A. Specifically, the antenna element 41 includes one base antenna element 41*a* and one end 41*b*. The antenna element 41 further includes a antenna element portion 42. The antenna element portion 42 extends from the base antenna element 41*a* toward the one end 41*b*. Thus, a whole of the antenna element portion 42 between the base antenna element 41*a* and the one end 41*b* is separated from the conductive surface 4 on the side surface 2*b* as it goes from the base antenna element 41*a* to the one end 41*b*. Further, the whole of the antenna element portion 42 between the base antenna element 41*a* and the one end 41*b* is separated from the conductive surface 5 on the side surface 2*c* as it goes from the base antenna element 41*a* to the one end 41*b*.

The base antenna element 41*a* is electrically coupled with the power supply point 7 at one corner of the front surface 2*a*. The one end 41*b* is electrically opened. A element length of the antenna element portion 42 is defined as a length from the base antenna element 41*a* to the one end 41*b*. The element length is one-fourth of the wavelength of the usage frequency of the electromagnetic wave. As shown in FIG. 6, the in-vehicle antenna device 1 is arranged near a corner, at which the roof 11 of the body of the vehicle and the pillar 12 intersect. Specifically, a whole of the front surface 2*a* of the dielectric element 2 contacts the windshield 13. The power supply cable 14 is coupled with the power supply point 7. Thus, the device in FIG. 6 provides the same effect as the device in FIG. 1.

Fifth Embodiment

Figure 7:
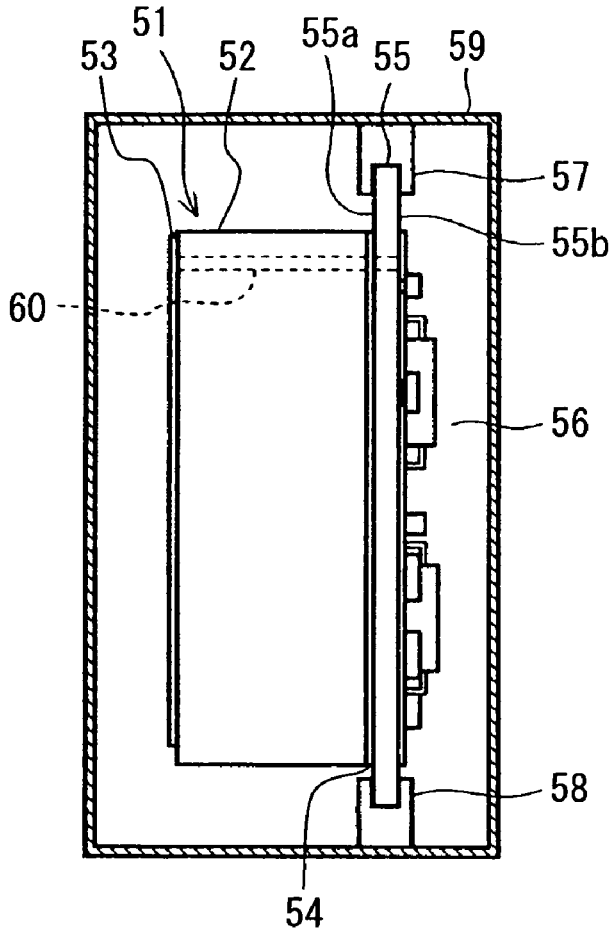
FIG. 7 is a diagram showing a cross sectional view of an in-vehicle antenna device according to a fifth embodiment.

An in-vehicle antenna device 51 according to a fifth embodiment is shown in FIG. 7. A front end circuit 56 is integrated with the in-vehicle antenna device 51. Specifically, in the device 51, an antenna element 53 is formed on a dielectric element 52. A conductive surface 54 is formed on a rear surface of the dielectric element 52. The device 51 is mounted on one surface 55*a* of a main substrate 55. In the dielectric element 52, the conductive surface is also formed on a side surface, similar to the device in FIG. 1.

The front end circuit 56 formed from various electric elements is mounted on the other surface 55*b* of the main substrate 55. The antenna device 51 and the front end circuit 56 are integrated with each other via the main substrate 55. The upper surface of the substrate 55 is supported on a substrate support element 57. The lower surface of the substrate 55 is supported on another substrate support element 58. Further, the substrate 55 is accommodated in a resin case 59. The antenna element 53 is energized via a power supply line 60, which penetrates the dielectric element 52 from a front end circuit side to an antenna element side. The device in FIG. 7 provides the same effect as the device in FIG. 1. Further, the front end circuit is integrated with the in-vehicle antenna device 51.

Other Embodiments

In the above in-vehicle antenna device 1, 51, the antenna element 3, 21, 31, 41, 53 may include a bypass portion as a short-cut portion for short-circuiting a part of the element 3, 21, 31, 41, 53 so as to form multiple passages having different passage lengths. Alternatively, the antenna element 3, 21, 31, 41, 53 may include a large width portion having a large width so as to form multiple passages having different passage lengths. Thus, the antenna element 3, 21, 31, 41, 53 provide multiple different element lengths, so that the usage frequency zone is broadened.

The dielectric element may be made of material having transparency or translucence. Alternatively, the conductive surface may have a mesh structure so as to transmit light through the mesh structure. The resin case 59 may be transparent or translucent. Thus, even when the device 1, 51 is mounted on the windshield of the vehicle, the vision of the driver of the vehicle is sufficiently secured.

The antenna device 1, 51 may be mounted on a front windshield, a rear windshield or a side windshield of the vehicle. Multiple in-vehicle antenna devices 1, 51 may be mounted on the vehicle so that a diversity effect is obtained.

The above disclosure has the following aspects.

According to an aspect of the present disclosure, an in-vehicle antenna device includes: a dielectric element having a front surface, first and second side surfaces and a rear surface, wherein a distance between the front surface and the rear surface is substantially equal to a product of one-fourth of a wavelength of an electromagnetic wave and a shortening ratio of the wavelength of the electromagnetic wave passing through the dielectric element, and wherein the dielectric element includes a power supply point disposed on both of the first and second side surfaces, a first conductive surface disposed on the first side surface, a second conductive surface disposed on the second side surface, and a third conductive surface disposed on the rear surface; and an antenna element including a base element and a branch element, wherein the base element is coupled with the power supply point at one corner of the front surface, wherein the branch element is connected to the base element and has an end opposite to the base element, and wherein a part of the branch element moves apart from one of the first and second conductive surfaces as it goes from the base element to the one end of the branch element. The front surface of the dielectric element is attached to a windshield of a vehicle near a corner, at which a roof and a pillar of the vehicle intersect.

In the above, device, since the first and second conductive surfaces function as a ground, the area of the device is reduced so that a vision of a driver of the vehicle is appropriately secured. Further, since the third conductive surface functions as a reflection plate, the electromagnetic wave is restricted from being irradiated into a compartment of the vehicle. Even when a communication device using the same communication frequency zone as the in-vehicle antenna device is disposed in the compartment of the vehicle, the communication device is not affected by the in-vehicle antenna. Furthermore, a gain of the antenna device to an outside of the compartment is improved. Since the first and second conductive surfaces function as a reflection plate, the electromagnetic wave is restricted from being irradiated to a side of the vehicle.

Alternatively, the branch element may include a first branch element and a second branch element, which are branched from the base element. The one end includes a first end of the first branch element and a second end of the second branch element. The first end is coupled with the first conductive surface, and the second end is coupled with the second conductive surface. The antenna element provides a double loop structure or a double turn-back structure.

Alternatively, the one end may be coupled with one of the first and second conductive surfaces. The antenna element provides a loop structure or a turn-back structure.

Alternatively, the one end may be electrically isolated from the first and second conductive surfaces. The antenna element provides an open end structure.

Alternatively, the dielectric element may be made of material having transparency or translucence.

Alternatively, each of the first to third conductive surfaces may be transparent.

Alternatively, the first side surface may be adjacent to the second side surface. The power supply point is isolated from the first and second conductive surfaces. The first branch element includes a first middle part, and the second branch element includes a second middle part. A distance between the first middle part and the first conductive surface increases as a position of the first branch element moves from the base element to the first end, and a distance between the second middle part and the second conductive surface increases as a position of the second branch element moves from the base element to the second end.

Alternatively, the first branch element may have a first element length, which is equal to a half of the wavelength of the electromagnetic wave, and the second branch element may have a second element length, which is equal to a half of the wavelength of the electromagnetic wave. The double loop structure or a double turn-back structure has a line-symmetry with reference to a line between the one corner of the front surface and an opposing corner of the front surface.

Alternatively, the first branch element may further include a first top part, and the second branch element includes a second top part. An angle between the base element and the first middle part is an obtuse angle, and an angle between the base element and the second middle part is an obtuse angle, and an angle between the first middle part and the first top part is an acute angle, and an angle between the second middle part and the second top part is an acute angle.

While the invention has been described with reference to preferred embodiments thereof, it is to be understood that the invention is not limited to the preferred embodiments and constructions. The invention is intended to cover various modification and equivalent arrangements. In addition, while the various combinations and configurations, which are preferred, other combinations and configurations, including more, less or only a single element, are also within the spirit and scope of the invention.

What is claimed is:

1. An in-vehicle antenna device comprising:

a dielectric element having a front surface, first and second side surfaces and a rear surface, wherein a distance between the front surface and the rear surface is substantially equal to a product of one-fourth of a wavelength of an electromagnetic wave and a shortening ratio of the wavelength of the electromagnetic wave passing through the dielectric element, and wherein the dielectric element includes a power supply point disposed on both of the first and second side surfaces, a first conductive surface disposed on the first side surface, a second conductive surface disposed on the second side surface, and a third conductive surface disposed on the rear surface; and an antenna element including a base element and a branch element, wherein the base element is coupled with the power supply point at one corner of the front surface, wherein the branch element is connected to the base element and has an end opposite to the base element, and wherein a part of the branch element moves apart from one of the first and second conductive surfaces as it goes from the base element to the one end of the branch element, wherein the front surface of the dielectric element is attached to a windshield of a vehicle near a corner, at which a roof and a pillar of the vehicle intersect.

2. The in-vehicle antenna device according to claim 1, wherein the branch element includes a first branch element and a second branch element, which are branched from the base element, wherein the one end includes a first end of the first branch element and a second end of the second branch element, wherein the first end is coupled with the first conductive surface, and the second end is coupled with the second conductive surface, and wherein the antenna element provides a double loop structure or a double turn-back structure.

3. The in-vehicle antenna device according to claim 2, wherein the first side surface is adjacent to the second side surface, wherein the power supply point is isolated from the first and second conductive surfaces, wherein the first branch element includes a first middle part, and the second branch element includes a second middle part, wherein a distance between the first middle part and the first conductive surface increases as a position of the first branch element moves from the base element to the first end, and wherein a distance between the second middle part and the second conductive surface increases as a position of the second branch element moves from the base element to the second end.

4. The in-vehicle antenna device according to claim 3, wherein the first branch element has a first element length, which is equal to a half of the wavelength of the electromagnetic wave, wherein the second branch element has a second element length, which is equal to a half of the wavelength of the electromagnetic wave, and wherein the double loop structure or a double turn-back structure has a line-symmetry with reference to a line between the one corner of the front surface and an opposing corner of the front surface.

5. The in-vehicle antenna device according to claim 4, wherein the first branch element further includes a first top part, and the second branch element includes a second top part, wherein an angle between the base element and the first middle part is an obtuse angle, and an angle between the base element and the second middle part is an obtuse angle, and wherein an angle between the first middle part and the first top part is an acute angle, and an angle between the second middle part and the second top part is an acute angle.

6. The in-vehicle antenna device according to claim 1, wherein the one end is coupled with one of the first and second conductive surfaces, and wherein the antenna element provides a loop structure or a turn-back structure.

7. The in-vehicle antenna device according to claim 1, wherein the one end is electrically isolated from the first and second conductive surfaces, and wherein the antenna element provides an open end structure.

8. The in-vehicle antenna device according to claim 1, wherein the dielectric element is made of material having transparency or translucence.

9. The in-vehicle antenna device according to claim 1, wherein each of the first to third conductive surfaces is transparent.

* * * * *